US011441575B2

(12) United States Patent
Tsukioka

(10) Patent No.: US 11,441,575 B2
(45) Date of Patent: Sep. 13, 2022

(54) AXIAL COMPRESSOR

(71) Applicant: HONDA MOTOR CO., LTD., Tokyo (JP)

(72) Inventor: Yuuri Tsukioka, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 84 days.

(21) Appl. No.: 17/163,755

(22) Filed: Feb. 1, 2021

(65) Prior Publication Data

US 2021/0317840 A1 Oct. 14, 2021

(30) Foreign Application Priority Data

Feb. 26, 2020 (JP) ..... JP2020-030899

(51) Int. Cl.

| | |
|---|---|
| ***F04D 19/00*** | (2006.01) |
| ***F04D 27/00*** | (2006.01) |
| ***F04D 29/52*** | (2006.01) |
| ***F04D 29/68*** | (2006.01) |
| ***F04D 29/32*** | (2006.01) |
| ***F04D 29/043*** | (2006.01) |

(52) U.S. Cl.

CPC ..... *F04D 29/322* (2013.01); *F04D 19/00* (2013.01); *F04D 27/00* (2013.01); *F04D 29/043* (2013.01); *F04D 29/522* (2013.01); *F04D 29/685* (2013.01)

(58) Field of Classification Search

CPC .... F04D 29/526; F04D 29/684; F04D 29/685; F04D 27/02; F04D 27/0207; F04D 27/0215; F04D 27/009; F01D 1/00; F01D 1/12

See application file for complete search history.

(56) References Cited

U.S. PATENT DOCUMENTS 5,586,859 A * 12/1996 Nolcheff ..... F04D 29/685 415/173.1
5,607,284 A * 3/1997 Byrne ..... F04D 29/526 415/58.7
6,585,479 B2 * 7/2003 Torrance ..... F04D 29/685 415/115
7,811,049 B2 * 10/2010 Xu ..... F04D 29/684 415/54.1

(Continued)

FOREIGN PATENT DOCUMENTS

EP 1832717 A1 * 9/2007 ..... F01D 11/08
JP 2003314496 A 11/2003

*Primary Examiner* — Topaz L. Elliott
*Assistant Examiner* — Jackson N Gillenwaters
(74) *Attorney, Agent, or Firm* — Armstrong Teasdale LLP

(57) ABSTRACT

An axial compressor includes: a rotary shaft rotatably supported in a cylindrical casing such that an annular fluid passage is defined therebetween; a rotor blade row including rotor blades provided on an outer circumferential surface of the rotary shaft; a stator blade row including stator blades provided on an inner circumferential surface of the casing at a position adjacent to and behind the rotor blade row; and a recirculation passage provided in the casing and having a suction port and an ejection port on downstream and upstream sides of the fluid passage, respectively. The suction port is located rearward of leading edges of bases of the stator blades, and the ejection port is located at a position forward of centers of tips of the rotor blades and at least partially opposing the tips of the rotor blades.

9 Claims, 6 Drawing Sheets

(56) References Cited

U.S. PATENT DOCUMENTS

| | | | | |
|---|---|---|---|---|
| 8,082,726 | B2 * | 12/2011 | Cloft | F02K 3/06 60/785 |
| 8,287,233 | B2 * | 10/2012 | Chen | F04D 29/4213 415/206 |
| 10,041,500 | B2 * | 8/2018 | Streit | F04D 29/324 |
| 2017/0175676 | A1 * | 6/2017 | Murooka | F04D 29/685 |

* cited by examiner

AXIAL COMPRESSOR

TECHNICAL FIELD

The present disclosure relates to an axial compressor provided with a recirculation passage.

BACKGROUND ART

A stator blade row (stationary blade row) of an axial compressor of a gas turbine for aircraft or the like is designed to be suitable for an inflow air volume in rated operation such as in cruise operation. Therefore, under low flow rate operation circumstances in non-rated operation such as when idling or taxiing, the inflow conditions are different from the rated conditions, and the rotor blade row does not operate stably. When the operation of the rotor blade row becomes unstable, a surging phenomenon can occur, and therefore, there is a demand to move the surging limit toward a low flow rate side in order to extend the operation region.

To meet such a demand, it has been proposed to perform self-circulating casing treatment to control stall so that the surging limit is moved toward the low flow rate side (see JP2003-314496A, for example).

However, there is room for improvement with regard to moving the surging limit toward the low flow rate side. Also, though the casing treatment can extend the surging limit in non-rated operation (in low flow rate operation), it can cause unnecessary energy loss in rated operation (cruise operation, etc.).

SUMMARY OF THE INVENTION

In view of such background, a primary object of the present invention is to provide an axial compressor capable of extending the surging limit in non-rated operation. A secondary object of the present invention is to reduce the energy loss in rated operation.

To achieve such an object, one embodiment of the present invention provides an axial compressor (42) comprising a cylindrical casing (14); a rotary shaft (26) rotatably supported in the casing such that an annular fluid passage (32) is defined between the rotary shaft and the casing; a rotor blade row (44) including multiple rotor blades (45) provided on an outer circumferential surface (26A) of the rotary shaft at a prescribed pitch around an axis (X) of the rotary shaft; a stator blade row (46) including multiple stator blades (47) provided on an inner circumferential surface (14B) of the casing at a position adjacent to and behind the rotor blade row with respect to an axial direction of the rotary shaft; and a recirculation passage (70) provided in the casing and having a suction port (72) provided on a downstream side of the fluid passage and an ejection port (74) provided on an upstream side of the fluid passage, wherein the suction port is located rearward of leading edges (47B) of bases (47A) of the stator blades, and the ejection port is located at a position forward of centers (45X) of tips (45A) of the rotor blades and at least partially opposing the tips of the rotor blades.

According to this configuration, due to the provision of the recirculation passage, the air flow rate is increased under low flow rate operation circumstances in non-rated operation, whereby the surging limit can be extended. Further, since the ejection port is located at a position forward of the center of the rotor blade row and at least partially overlapping with the rotor blade row, the surging limit can be further extended compared to the case where the ejection port is located forward of the rotor blade row.

Preferably, a center (74X) of the ejection port is positioned rearward of leading edges (45B) of the tips of the rotor blades. More preferably, a front edge (74A) of the ejection port is positioned rearward of the leading edges of the tips of the rotor blades.

According to these configurations, the surging limit can be extended further.

Preferably, the center of the ejection port is positioned in a range from 0% chord position to 30% chord position with respect to the tips of the rotor blades. More preferably, the center of the ejection port is positioned in a range from 0% chord position to 20% chord position with respect to the tips of the rotor blades. Further preferably, the center of the ejection port is positioned in a range from 0% chord position to 10% chord position with respect to the tips of the rotor blades.

According to these configurations, the surging limit can be extended further.

Preferably, a center (72X) of the suction port is located rearward of trailing edges (47C) of the bases of the stator blades.

According to this configuration, compared to the case where the center of the suction port is positioned forward of the trailing edges of the bases of the stator blades, it is possible to effectively increase the air flow rate thereby to extend the surging limit.

Preferably, the axial compressor further comprises a flow control device (82) capable of adjusting a flow rate of recirculation air that flows through the recirculation passage.

According to this configuration, it is possible to reduce the energy loss in rated operation by adjusting the flow rate of the recirculation air.

Preferably, the recirculation passage includes an annular chamber (76) formed in the casing to surround the fluid passage, a suction passage (78) connecting the annular chamber and the suction port, and an ejection passage (80) connecting the annular chamber and the ejection port, and the flow control device includes a partition wall (84) dividing the annular chamber into an upstream section on a side of the suction passage and a downstream section on a side of the ejection passage, and a flow control valve (88) provided in the partition wall.

According to this configuration, the flow control device can be provided in the casing as a simple configuration. Also, the flow rate of the recirculation air can be accurately adjusted by the flow control valve.

Thus, according to the present invention, it is possible to provide an axial compressor capable of extending the surging limit in non-rated operation.

DESCRIPTION OF THE PREFERRED EMBODIMENT(S)

In the following, an embodiment of the present invention will be described in detail with reference to the appended drawings.

First, an overview of a gas turbine engine (turbofan engine) 10 for aircraft in which the axial compressor of the present embodiment is used will be described with reference to FIG. 1.

Figure 1:
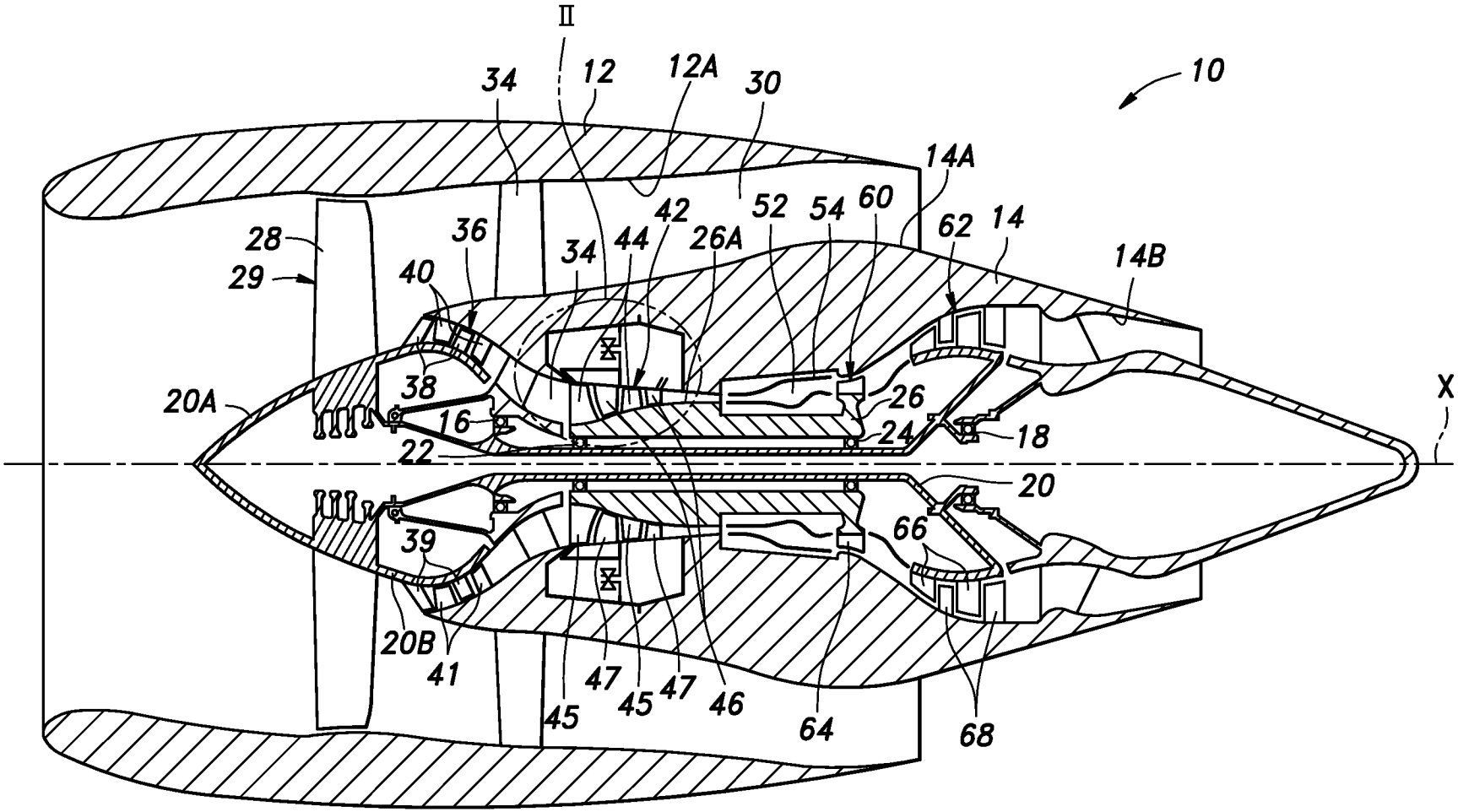
FIG. 1 is a sectional view showing an overall structure of a gas turbine engine for aircraft including an axial compressor according to an embodiment of the present invention.

As shown in FIG. 1, the gas turbine engine 10 includes a substantially cylindrical outer casing 12 and an inner casing 14 that are arranged coaxially. The inner casing 14 rotatably supports a low pressure rotary shaft (rotor) 20 therein via a front first bearing 16 and a rear first bearing 18. The low pressure rotary shaft 20 rotatably supports a tubular high pressure rotary shaft 26 on the outer circumference thereof via a front second bearing 22 and a rear second bearing 24. The low pressure rotary shaft 20 and the high pressure rotary shaft 26 are arranged coaxially, and the central axis thereof is denoted by a reference sign "X."

The low pressure rotary shaft 20 includes a substantially conical tip portion 20A that protrudes forward of the inner casing 14. An outer circumference of the tip portion 20A is provided with a front fan 28 including multiple fan blades 29 which are arranged to be spaced apart from one another in the circumferential direction. On a downstream side of the front fan 28, a bypass duct 30 defined between the outer casing 12 and the inner casing 14 to have an annular cross-sectional shape and an air compression duct (fluid passage) 32 defined coaxially (to be coaxial with the central axis X) in the inner casing 14 to have an annular cross-sectional shape are provided in parallel with each other. The bypass duct 30 is provided with multiple stator vanes 34, each having an outer end joined to the inner circumferential surface 12A of the outer casing 12 and an inner end joined to the outer circumferential surface 14A of the inner casing 14, such that the stator vanes 34 are arranged to be spaced apart from one another at a prescribed interval in the circumferential direction.

A low pressure axial compressor 36 is provided in an inlet of the air compression duct 32. The low pressure axial compressor 36 includes two (front and rear) low pressure rotor blade rows 38 provided on an outer circumference of the low pressure rotary shaft 20 and two (front and rear) low pressure stator blade rows 40 provided in the inner casing 14, such that the low pressure rotor blade rows 38 and the low pressure stator blade rows 40 are arranged adjacent to each other and alternate in the axial direction.

Each of the low pressure rotor blade rows 38 includes multiple low pressure rotor blades 39 extending radially outward from an outer circumferential surface 20B of the tip portion 20A of the low pressure rotary shaft 20 in a cantilever fashion and arranged around the axis X of the low pressure rotary shaft 20 at a prescribed pitch. Each of the low pressure stator blade rows 40 includes multiple low pressure stator blades 41 extending radially inward from an inner circumferential surface 14B of the inner casing 14 in a cantilever fashion and arranged around the axis X of the low pressure rotary shaft 20 at a prescribed pitch at a position adjacent to and behind the corresponding low pressure rotor blade row 38 with respect to the axial direction of the low pressure rotary shaft 20.

Figure 2:
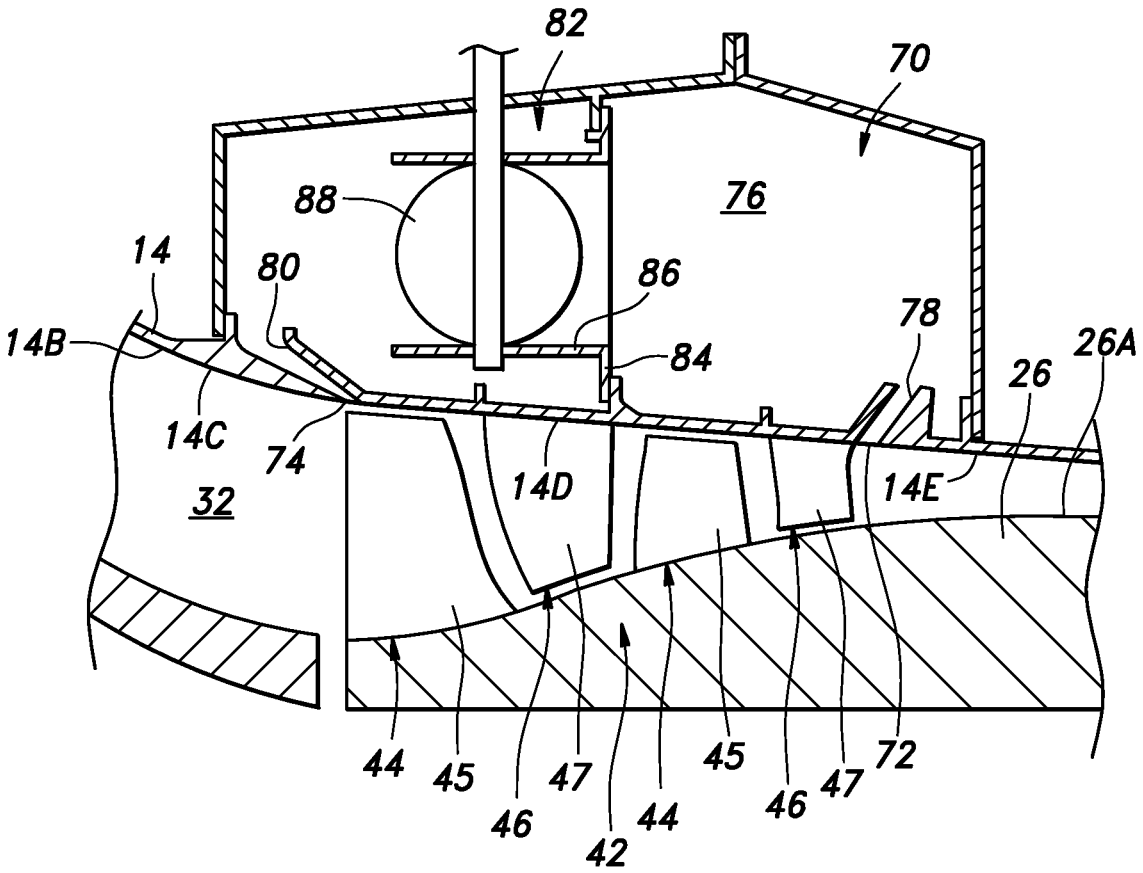
FIG. 2 is an enlarged view of part II in FIG. 1 (partial enlarged sectional view of a high pressure axial compressor)

A high pressure axial compressor 42 is provided in an outlet of the air compression duct 32. FIG. 2 is an enlarged view of part II in FIG. 1, namely, a partial enlarged sectional view of the high pressure axial compressor 42. As also shown in FIG. 2, the high pressure axial compressor 42 includes two (front and rear) high pressure rotor blade rows 44 provided on an outer circumferential surface 26A of the high pressure rotary shaft 26 and two (front and rear) high pressure stator blade rows 46 provided in the inner casing 14, such that the high pressure rotor blade rows 44 and the high pressure stator blade rows 46 are arranged adjacent to each other and alternate in the axial direction.

Each of the high pressure rotor blade rows 44 includes multiple high pressure rotor blades 45 extending radially outward from an outer circumferential surface 20B of the low pressure rotary shaft 20 in a cantilever fashion and arranged around the axis X of the low pressure rotary shaft 20 at a prescribed pitch. Each of the high pressure stator blade rows 46 includes multiple high pressure stator blades 47 extending radially inward from the inner circumferential surface 14B of the inner casing 14 in a cantilever fashion and arranged around the axis X of the low pressure rotary shaft 20 at a prescribed pitch at a position adjacent to and behind the corresponding high pressure rotor blade row 44 with respect to the axial direction of the low pressure rotary shaft 20.

As shown in FIG. 1, on a downstream side of the high pressure axial compressor 42, a combustion chamber member 54 is provided to define a combustion chamber 52 to which compressed air is supplied from the high pressure axial compressor 42. The inner casing 14 is provided with multiple fuel injection nozzles (not shown) for injecting fuel into the combustion chamber 52. The combustion chamber 52 produces high-pressure combustion gas by combusting air-fuel mixture.

On a downstream side of the combustion chamber 52, a high pressure turbine 60 and a low pressure turbine 62 are provided such that the combustion gas produced in the combustion chamber 52 is blown thereto. The high pressure turbine 60 includes a high pressure turbine wheel 64 fixed to an outer circumference of the high pressure rotary shaft 26. The low pressure turbine 62 is provided on a downstream side of the high pressure turbine 60 and includes at least one (two in FIG. 1) low pressure turbine wheel 66 provided on an outer circumference of the low pressure rotary shaft 20 and at least one (two in FIG. 1) nozzle guide vane row 68 fixed to the inner casing 14 which are arranged in the axial direction.

At the start of the gas turbine engine 10, a starter motor (not shown in the drawings) drives the high pressure rotary shaft 26 to rotate. Once the high pressure rotary shaft 26 starts rotating, the air compressed by the high pressure axial compressor 42 is supplied to the combustion chamber 52, and air-fuel mixture combustion takes place in the combustion chamber 52 to produce combustion gas. The combustion gas is blown to the high pressure turbine wheel 64 and the low pressure turbine wheel 66 to rotate the high pressure turbine wheel 64 and the low pressure turbine wheel 66.

Thereby, the low pressure rotary shaft 20 and the high pressure rotary shaft 26 rotate, which causes the front fan 28 to rotate and brings the low pressure axial compressor 36 and the high pressure axial compressor 42 into operation, whereby the compressed air is supplied to the combustion chamber 52. Therefore, the gas turbine engine 10 continues to operate after the starter motor is stopped.

During the operation of the gas turbine engine 10, part of the air suctioned by the front fan 28 passes through the bypass duct 30 and is blown out rearward, and generates the main thrust particularly in a low-speed flight. The remaining part of the air suctioned by the front fan 28 is supplied to the combustion chamber 52 and mixed with the fuel and combusted, and the combustion gas is used to drive the low pressure rotary shaft 20 and the high pressure rotary shaft 26 to rotate before being blown out rearward to generate thrust.

Next, a recirculation structure provided in the high pressure axial compressor 42 will be described with reference to FIG. 2.

The high pressure axial compressor 42 is provided with a recirculation passage 70 for recirculating the air flowing in the air compression duct 32 (fluid passage) from a downstream side to an upstream side. The recirculation passage 70 is defined on the outer circumference side of the air compression duct 32, namely, in the inner casing 14, and a suction port 72 and an ejection port 74, which are an upstream end and a downstream end of the recirculation passage 70, open on the inner circumferential surface 14B of the inner casing 14. Each of the suction port 72 and the ejection port 74 has a slit-like shape and is formed annularly on the inner circumferential surface 14B of the inner casing 14. Therefore, the inner circumferential surface 14B of the inner casing 14 is divided into a front portion 14C located forward of the ejection port 74, a middle portion 14D located between the ejection port 74 and the suction port 72, and a rear portion 14E located rearward of the suction port 72.

The recirculation passage 70 includes an annular chamber 76 formed in the inner casing 14 so as to surround the air compression duct 32, a suction passage 78 connecting the annular chamber 76 and the suction port 72, and an ejection passage 80 connecting the annular chamber 76 and the ejection port 74. The suction passage 78 and the ejection passage 80 each have a substantially disk-like shape extending radially outward from the suction port 72 and the ejection port 74, respectively.

The suction port 72 is formed near the rear end of the rearmost high pressure stator blade row 46, and the ejection port 74 is formed near the front end of the frontmost high pressure rotor blade row 44. When the high pressure axial compressor 42 is in operation, the pressure of the air compression duct 32 becomes higher in the downstream side portion in which the suction port 72 is provided than in the upstream side portion in which the ejection port 74 is provided. As a result, the air in the air compression duct 32 is recirculated from the downstream side to the upstream side of the air compression duct 32 via the recirculation passage 70.

Thereby, the flow rate (mass flow rate) of the air flowing through the part of the air compression duct 32 where the high pressure axial compressor 42 is provided increases, and therefore, the surging limit under low flow rate operation circumstances in non-rated operation is extended.

Inside the annular chamber 76, a flow control device 82 for adjusting the flow rate of the recirculation air that flows through the recirculation passage 70 is provided. Specifically, a partition wall 84 is provided in the annular chamber 76 to divide the annular chamber 76 into an upstream section on the side of the suction passage 78 and a downstream section on the side of the ejection passage 80. The partition wall 84 is integrally provided with a communication pipe 86 that brings the upstream section and the downstream section into communication with each other, and a flow control valve 88 is installed in the communication pipe 86.

Depending on the operation state of the gas turbine engine 10, the flow control valve 88 narrows the passage of the communication pipe 86 to adjust the flow rate of the recirculation air, whereby the energy loss in rated operation can be reduced.

Figure 3:
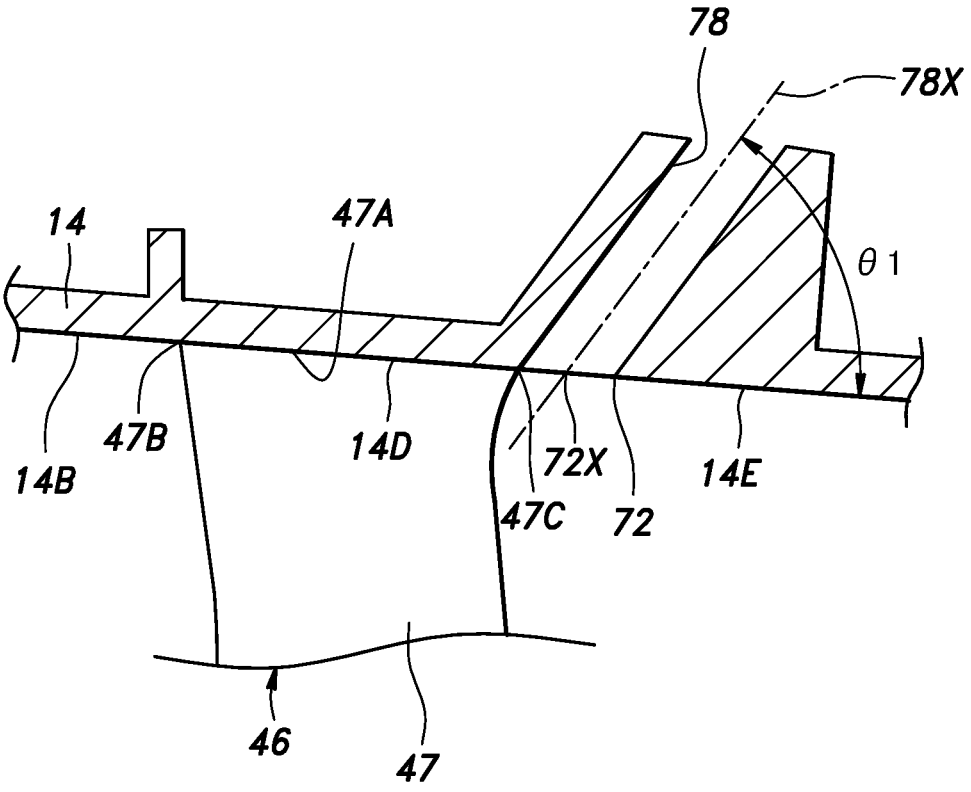
FIG. 3 is an enlarged sectional view of a suction passage shown in FIG. 2.

FIG. 3 is an enlarged sectional view of the suction passage 78 shown in FIG. 2. As shown in FIG. 3, the suction passage 78 extends radially outward from the inner circumferential surface 14B of the inner casing 14, in which the suction port 72 constituting the upstream end of the suction passage 78 is formed, such that the suction passage 78 has a constant width in the fore and aft direction. The center 78X of the suction passage 78 is inclined rearward (toward the downstream side of the air compression duct 32) at a first angle θ1 relative to the inner circumferential surface 14B of the inner casing 14 as it extends from the suction port 72. Thereby, the air flowing through the recirculation passage 70 is allowed to enter the suction passage 78 with a small resistance.

As described above, the suction port 72 is formed near the rear end of the rearmost high pressure stator blade row 46. Specifically, the suction port 72 is formed at a position where the front edge thereof aligns with or is located slightly rearward of the trailing edges (rear ends) 47C of the bases 47A of the high pressure stator blades 47 of the rearmost row. The center 72X of the suction port 72 is located rearward of the trailing edges 47C of the bases 47A of the high pressure stator blades 47 of the rearmost row. As a result of providing the suction port 72 at such a position, the pressure difference between the inlet and outlet of the recirculation passage 70 becomes large and the flow rate of the recirculation air increases. Note that it is only required that the suction port 72 is located rearward of the leading edges (front ends) 47B of the bases 47A of the high pressure stator blades 47. Thereby, the air flowing through the air compression duct 32 enters the suction passage 78 and is recirculated to the upstream side through the recirculation passage 70.

Figure 4:
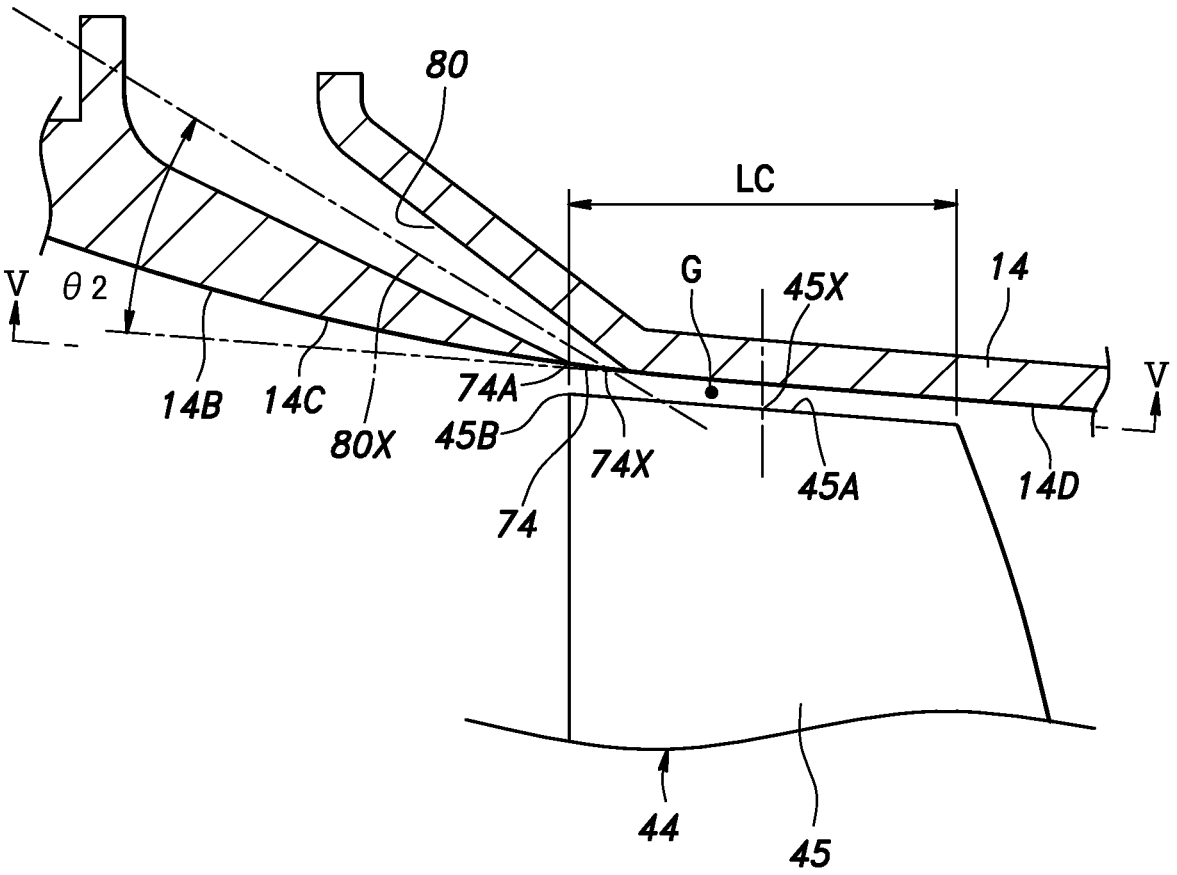
FIG. 4 is an enlarged sectional view of an ejection passage shown in FIG. 2.
Figure 5:
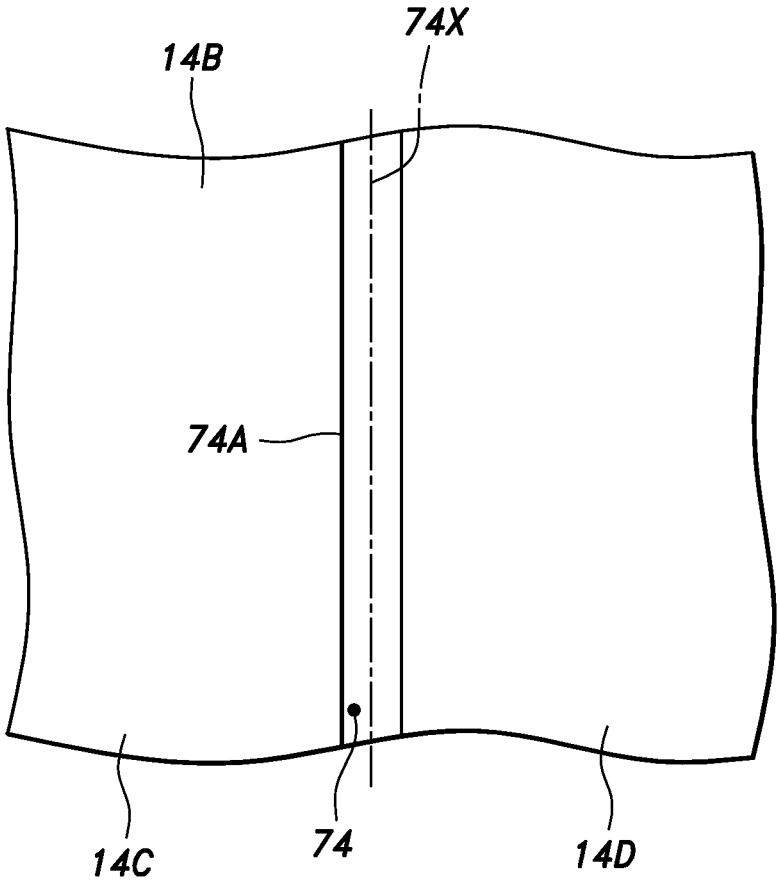
FIG. 5 is a development view of a main part of an inner circumferential surface of an inner casing as viewed along line V-V in FIG. 4.

FIG. 4 is an enlarged sectional view of the ejection passage 80 shown in FIG. 2, and FIG. 5 is a development view of a main part of the inner circumferential surface 14B of the inner casing 14 along line V-V in FIG. 4. As shown in FIGS. 4 and 5, the ejection passage 80 is shaped to be narrower toward the ejection port 74 forming the downstream end thereof. Thereby, the air flowing through the recirculation passage 70 is eject vigorously from the ejection port 74. The center 80X of the ejection passage 80 is inclined forward (toward the upstream side of the air compression duct 32) at a second angle θ2 relative to the inner circumferential surface 14B of the inner casing 14 as it extends from the ejection port 74. Thereby, the air flowing through the recirculation passage 70 is ejected rearward (toward the downstream side of the air compression duct 32) from the ejection port 74.

As described above, the ejection port 74 is formed near the front end of the frontmost high pressure rotor blade row 44. Specifically, the front edge 74A of the ejection port 74 is positioned rearward of the leading edges (front ends) 45B of the tips (free end edges) 45A of the high pressure rotor blades 45, and the center 74X of the ejection port 74 is positioned in a range from 0% chord position to 10% chord position with respect to the tips 45A of the high pressure rotor blades 45. In the present embodiment, the entirety of the ejection port 74 is positioned in the range from 0% chord position to 10% chord position with respect to the tips 45A of the high pressure rotor blades 45. As a result of providing the ejection port 74 at such a position, the energy loss in rated operation is reduced and the stall of the gas turbine engine 10 is suppressed.

To explain in detail, there is a gap G between the tips 45A of the high pressure rotor blades 45 and the inner circumferential surface 14B of the inner casing 14. Therefore, when the high pressure axial compressor 42 is in operation, air leaks from the gap G, and the air that has leaked forms a vortex. The vortex is generated at the leading edges 45B of the tips 45A of the high pressure rotor blades 45 and develops toward the rear. Since the ejection port 74 is formed near the leading edges 45B of the tips 45A of the high pressure rotor blades 45 and the recirculation air is ejected from the ejection port 74, the generation of the vortex by the leakage flow is suppressed, whereby the energy loss is reduced.

It is to be noted, however, that the position of the ejection port 74 is not limited to that in the embodiment so long as the generation or development of the vortex can be suppressed by the ejection of the recirculation air. Specifically, the ejection port 74 may be located at a position forward of the centers 45X of the tips 45A of the high pressure rotor blades 45 of the frontmost row and at least partially opposing the tips 45A of the high pressure rotor blades 45.

Here, to suppress the generation of the vortex by the leakage flow, it is preferred that the recirculation air is ejected toward the leading edges 45B of the tips 45A of the high pressure rotor blades 45. Therefore, the center 74X of the ejection port 74 is preferably positioned rearward of the leading edges 45B of the tips 45A of the high pressure rotor blades 45. Also, it is more preferable if the front edge 74A of the ejection port 74 is positioned rearward of the leading edges 45B of the tips 45A of the high pressure rotor blades 45.

It is to be noted that instead of ejecting the recirculation air toward the leading edges 45B of the tips 45A of the high pressure rotor blades 45, it is possible to eject the recirculation air toward the vortex immediately after generation (namely, immediately behind the leading edges 45B) so that the vortex is disturbed and the development of the vortex is suppressed. However, the more rearward the recirculation air is ejected to, the smaller the influence that the ejection of the recirculation air imparts on the developed vortex. Therefore, it is preferred that the ejection port 74 is provided at a position near the leading edges 45B of the tips 45A of the high pressure rotor blades 45.

Specifically, it is preferred that the center 74X of the ejection port 74 is positioned in a range from 0% chord position to 30% chord position with respect to the tips 45A of the high pressure rotor blades 45. The chord position is defined relative to the leading edges 45B of the tips 45A of the high pressure rotor blades 45 (0%). Provided that the chord length of the tip 45A of each high pressure rotor blade 45 is represented by LC, the range from 0% chord position to 30% chord position can be expressed as 0 to 0.3 LC. Also, it is more preferable if the center 74X of the ejection port 74 is positioned in a range from 0% chord position to 20% chord position with respect to the tips 45A of the high pressure rotor blades 45 (0 to 0.2 LC). Further preferably, the center 74X of the ejection port 74 is positioned in a range from 0% chord position to 10% chord position with respect to the tips 45A of the high pressure rotor blades 45 (0 to 0.1 LC).

Figure 6:
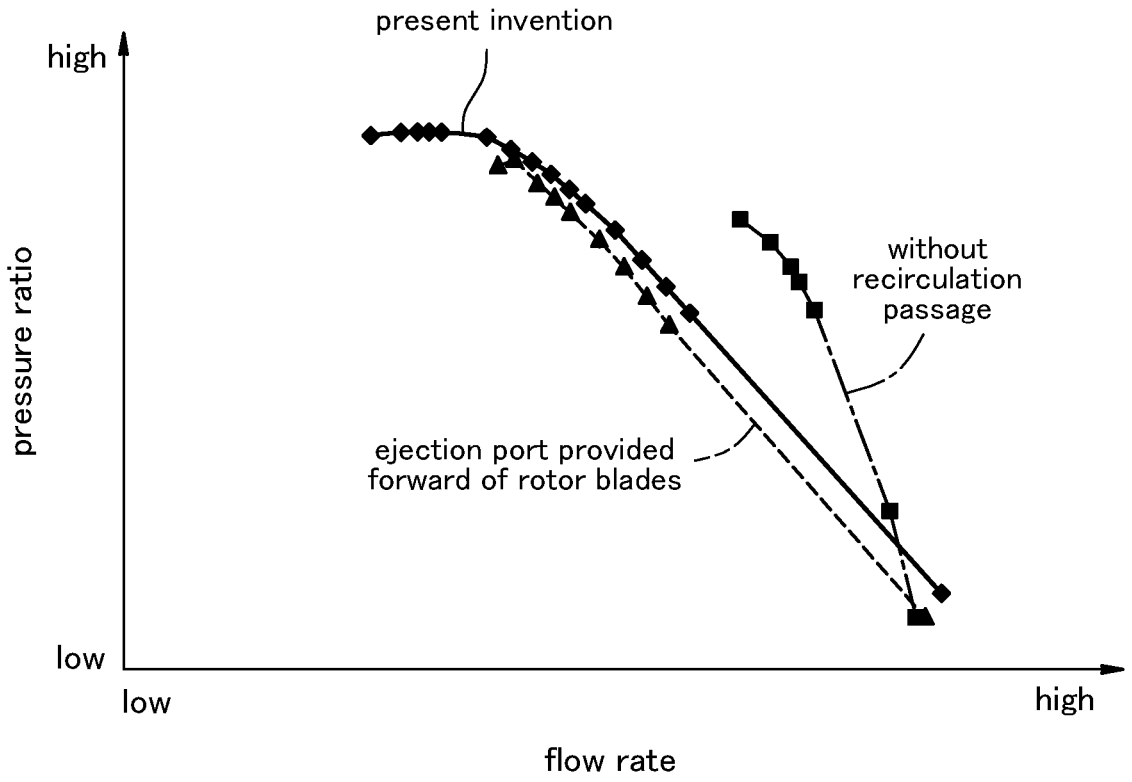
FIG. 6 is a graph showing the pressure characteristics of the axial compressor.

FIG. 6 is a graph showing the pressure characteristics of the axial compressor according to the embodiment. FIG. 6 also shows the pressure characteristics of two comparative examples, namely, a case where the recirculation passage 70 is not provided and a case where the ejection port 74 of the recirculation passage 70 is provided forward of the leading edges 45B of the tips 45A of the high pressure rotor blades 45. The horizontal axis of the graph represents the flow rate (mass flow rate) in the air compression duct 32 and the vertical axis of the graph represents the pressure ratio between a part of the air compression duct 32 forward of the high pressure rotor blades 45 of the frontmost row and a part of the air compression duct 32 behind the high pressure stator blades 47 of the rearmost row.

It can be appreciated from this graph that in the case where the recirculation passage 70 is not provided, the pressure ratio increases rapidly as the flow rate decreases, while in the case where the recirculation passage 70 is provided, the increase in the pressure ratio when the flow rate decreases is suppressed. The upper left end point of each curve represents the value of the flow rate immediately before the gas turbine engine 10 stalled, and it can be seen that in the present invention, the stall margin of the gas turbine engine 10 is improved by 41% compared to the case where the recirculation passage 70 is not provided.

Also, compared to the case where the ejection port 74 is provided in front of the leading edges 45B of the tips 45A of the high pressure rotor blades 45, the engine stall did not occur at a lower flow rate in the present invention in which the ejection port 74 is provided in the range from 0% chord position to 10% chord position of the high pressure rotor blades 45 (0 to 0.1 LC).

A concrete embodiment of the present invention has been described in the foregoing, but the present invention is not limited to the above-described embodiment and various alterations and modifications may be made. For example, in the above-described embodiment, the axial compressor of the present invention was embodied as the high pressure axial compressor 42 of the gas turbine engine 10 for aircraft, but the axial compressor of the present invention may be used as the low pressure axial compressor 36. Also, the present invention may be applied to an axial compressor used in gas turbine engines for ships, automobiles, stationary power generators, pumps, etc. Further, the present invention may be applied to an axial compressor used in industrial machinery such as gas-liquid separators, dust collectors, vacuum pumps, etc.

In the above-described embodiment, the recirculation passage 70 has the suction port 72 near the rear end of the rearmost high pressure stator blade row 46 and the ejection port 74 near the front end of the frontmost high pressure rotor blade row 44, but the positions of the suction port 72 and the ejection port 74 are not limited to the embodiment. For example, the suction port 72 may be provided near the rear end of one of the high pressure stator blade rows 46 that is located forward of the rearmost one. Also, the ejection port 74 may be provided near the front end of one of the high pressure rotor blade rows 44 that is located rearward of the frontmost one. Moreover, the recirculation passage 70 may be provided for each pair of the high pressure stator blade row 46 and the high pressure rotor blade row 44.

The above-described embodiment has a single communication pipe 86 and a single flow control valve 88, but more than one communication pipe 86 may be provided and more than one flow control valve 88 may be provided. Also, the flow control device 82 is not limited to the flow control valve 88 provided in the partition wall 84 and may be realized as a movable partition wall capable of adjusting the flow rate of the recirculation air, for example.

Besides, the concrete structure, arrangement, number, angle, etc. of the components of the embodiment may be appropriately changed within the scope of the present invention. Also, not all of the components shown in the above-described embodiment are necessarily indispensable and they may be selectively adopted as appropriate.

The invention claimed is:

1. An axial compressor comprising:

a cylindrical casing;

a rotary shaft rotatably supported in the casing such that an annular fluid passage is defined between the rotary shaft and the casing;

a rotor blade row including multiple rotor blades provided on an outer circumferential surface of the rotary shaft at a prescribed pitch around an axis of the rotary shaft;

a stator blade row including multiple stator blades provided on an inner circumferential surface of the casing at a position adjacent to and behind the rotor blade row with respect to an axial direction of the rotary shaft; and a recirculation passage provided in the casing and having a suction port provided on a downstream side of the fluid passage and an ejection port provided on an upstream side of the fluid passage, wherein the suction port is located rearward of leading edges of bases of the stator blades, and the ejection port is located at a position forward of centers of tips of the rotor blades and at least partially opposing the tips of the rotor blades.

2. The axial compressor according to claim 1, wherein a center of the ejection port is positioned rearward of leading edges of the tips of the rotor blades.

3. The axial compressor according to claim 2, wherein a front edge of the ejection port is positioned rearward of the leading edges of the tips of the rotor blades.

4. The axial compressor according to claim 2, wherein the center of the ejection port is positioned in a range from 0% chord position to 30% chord position with respect to the tips of the rotor blades.

5. The axial compressor according to claim 4, wherein the center of the ejection port is positioned in a range from 0% chord position to 20% chord position with respect to the tips of the rotor blades.

6. The axial compressor according to claim 5, wherein the center of the ejection port is positioned in a range from 0% chord position to 10% chord position with respect to the tips of the rotor blades.

7. The axial compressor according to claim 1, wherein a center of the suction port is located rearward of trailing edges of the bases of the stator blades.

8. The axial compressor according to claim 1, further comprising a flow control device capable of adjusting a flow rate of recirculation air that flows through the recirculation passage.

9. The axial compressor according to claim 8, wherein the recirculation passage includes an annular chamber formed in the casing to surround the fluid passage, a suction passage connecting the annular chamber and the suction port, and an ejection passage connecting the annular chamber and the ejection port, and the flow control device includes a partition wall dividing the annular chamber into an upstream section on a side of the suction passage and a downstream section on a side of the ejection passage, and a flow control valve provided in the partition wall.

* * * * *